United States Patent [19]

Takagi

[11] Patent Number: 4,909,443

[45] Date of Patent: Mar. 20, 1990

[54] WATER SPRAYING NOZZLE

[76] Inventor: Toshio Takagi, No. 3-5-1305, Shiragane 1-chome, Kokurakita-ku, Kitakyushu-shi, Fukuoka-ken, Japan

[21] Appl. No.: 311,642

[22] Filed: Feb. 16, 1989

[30] Foreign Application Priority Data

Feb. 27, 1988 [JP] Japan ..... 63-45517

[51] Int. Cl.[4] ..... B05B 1/16; B05B 1/32

[52] U.S. Cl. ..... 239/440; 239/441; 239/444; 239/457; 239/526; 239/538; 239/574

[58] Field of Search ..... 239/438–441, 239/446, 448, 449, 457, 458, 526, 538, 539, 541, 574, 579

[56] References Cited

U.S. PATENT DOCUMENTS

| | | | |
|---|---|---|---|
| 2,732,171 | 1/1956 | Paradise | 239/574 |
| 4,204,646 | 5/1980 | Shames et al. | 239/449 |
| 4,265,405 | 5/1981 | Takagi | 239/440 |
| 4,618,100 | 10/1986 | White et al. | 239/440 |
| 4,666,085 | 5/1987 | Liaw | 239/526 |
| 4,785,998 | 11/1988 | Takagi | 239/440 |

FOREIGN PATENT DOCUMENTS

| | | | |
|---|---|---|---|
| 116459 | 9/1980 | Japan . | |
| 2155817 | 10/1985 | United Kingdom | 239/447 |

*Primary Examiner*—Andres Kashnikow
*Assistant Examiner*—Michael J. Forman
*Attorney, Agent, or Firm*—Felfe & Lynch

[57] ABSTRACT

A water spraying nozzle has a horizontal water spraying portion and a handle portion provided on a rear downward portion of the water spraying portion and inclined obliquely rearward. The water spraying portion has at its front portion a water spraying head portion and at its rear portion a cylinder base portion connected to the water spraying head portion. The water spraying head portion includes an outer cylinder rotatably connected at its rear end to the cylinder base portion, an intermediate cylinder disposed within the outer cylinder, and an inner cylinder disposed within the intermediate cylinder in such a manner as to be longitudinally slidable in response to the rotation of the outer cylinder. The outer cylinder defines at its front end an opening on which is mounted a porous plate. The inner cylinder has at a front portion thereof a valve portion for opening and closing a water spraying opening provided in the intermediate cylinder and also a first through-hole communicating the inside and the outside thereof. A rear portion of the inner cylinder is connected to a first water conduit. The first through-hole allows the inside of the inner cylinder to communicate with the water spraying opening in the first half of the retraction of the inner cylinder in response to the rotation of the outer cylinder and with the porous plate in the latter half of the retraction. The handle portion has a fixed portion fixed at its upper end to the water spraying portion and an opening-closing portion mounted to the fixed portion in such a manner as to be able to open and close relative thereto. A second water conduit capable of communicating with the first water conduit is disposed within the fixed portion, and is opened or closed by a valve member provided in the opening-closing portion.

4 Claims, 7 Drawing Sheets

WATER SPRAYING NOZZLE

BACKGROUND OF THE INVENTION

1. Field of the Invention

The present invention relates to a water spraying nozzle.

2. Description of the Prior Art

The applicant of the present invention previously filed an application for a patent on one of water spraying nozzles of this type, which was issued as U.S. Pat. No. 4,785,998. This water spraying nozzle eliminated certain drawbacks of the apparatus of Japanese Patent Application No. 24644/1979 (Laid-Open No. 116459/1980) that had already been known. Namely, the improved water spraying nozzle has a small number of parts which can be easily assembled to allow production of the water spraying nozzle at a low cost, and its handling is easy so that even an awkward woman or child user can easily operate it.

This prior art, however, has the following drawback. That is, when the discharge of water is to be terminated, it is necessary either to move an adjusting cylinder consisting of an outer cylinder fitted around an inner cylinder that constitutes a nozzle body, to a water discharge stopping position relative to the nozzle body, or to close a water faucet through which water is being supplied to the water spraying nozzle. In consequence, the discharge of water continues unnecessarily during the time in which the adjusting cylinder is being moved to the water discharge stopping position, or in which the user moves from the water spraying position to the location of the water faucet. This results in a waste of water.

The prior art has another drawback. Because the water spraying nozzle has no portion which may be suitably gripped by the hand, the user has to grip a gripping sleeve linearly connected to the nozzle body. In consequence, there is a risk that, during such operations as the moving of the adjusting cylinder, the direction in which water is being discharged may deviate from what is intended.

SUMMARY OF THE INVENTION

It is therefore an object of the present invention to eliminate such drawbacks of the conventional water spraying nozzle, and to provide a water spraying nozzle which does not require any troublesome operations such as the operation of the outer cylinder or the closing of the water faucet each time water spraying is to be terminated, so that there is no risk of water being wasted, and which also allows one to positively maintain the direction of water being discharged in a fixed direction even when the outer cylinder is being operated.

In order to accomplish the above object, the present invention provides a water spraying nozzle comprising: a horizontal water spraying portion; and a handle portion provided on a rear downward portion of the water spraying portion and inclined obliquely rearward, the water spraying portion having at its front portion a water spraying head portion and at its rear portion a cylinder base portion connected to the water spraying head portion, the water spraying head portion including an outer cylinder rotatably connected at its rear end to the cylinder base portion, an intermediate cylinder disposed within the outer cylinder, and an inner cylinder disposed within the intermediate cylinder in such a manner as to be longitudinally slidable in response to the rotation of the outer cylinder, the outer cylinder defining at its front end an opening on which is mounted a porous plate, the inner cylinder having at a front portion thereof a valve portion for opening and closing a water spraying opening provided in the intermediate cylinder and also a first through-hole communicating the inside and the outside thereof, a rear portion of the inner cylinder being connected to a first water conduit, the first through-hole allowing the inside of the inner cylinder to communicate with the water spraying opening in the first half of the retraction of the inner cylinder in response to the rotation of the outer cylinder and with the porous plate in the latter half of the retraction, the handle portion having a fixed portion fixed at its upper end to the water spraying portion and an opening-closing portion mounted to the fixed portion in such a manner as to be able to open and close relative thereto, a second water conduit capable of communicating with the first water conduit being disposed within the fixed portion, the second water conduit being opened or closed by a valve member provided in the opening-closing portion.

In the water spraying nozzle having the above construction, a water spraying operation is performed in the following manner. After the second water conduit has been connected to a water supply hose such as a hose one end of which is connected to a water faucet, when the opening-closing portion of the handle portion is manually gripped, the valve member operates to automatically open the second water conduit. When the second water conduit is thus opened, water is supplied through the first water conduit into the water spraying portion. Subsequently, when the outer cylinder is rotated relative to the cylinder base portion, water is discharged in one of various modes through the opening of the intermediate cylinder or the porous plate at the opening of the outer cylinder. On the other hand, when the discharge of water is to be terminated, it suffices if the opening-closing portion is operated in the reverse manner so that the valve member acts to close the second water conduit. In this way, an operation of discharging water can be started and terminated independently of the rotation of the outer cylinder. In addition, since the handle portion remains manually gripped throughout use, water can always be stably oriented to a desired direction as the water is being discharged.

In a preferred embodiment of the present invention, a rotary valve member is provided at the junction of the first and second water conduits to establish or block the communication between the first and second water conduits. By virtue of the provision of this rotary valve, if it is difficult for some reason or other to operate the opening-closing portion of the handle portion, the rotary valve may be operated instead for the purpose of starting or terminating a water discharging operation in the same manner as that possible in the case where the opening-closing portion is operated.

Thus, according to the present invention, a water discharging operation is automatically started and terminated by operating either the valve member of the opening-closing portion, or the rotary valve at the junction of the first and second water conduits. As a result, it is possible to avoid any wastage of water as occurs with the conventional water spraying nozzle.

In another embodiment of the present invention, a mechanism for moving the inner cylinder in the backand-forth direction is adopted, in which guiding projections each provided with a male screw portion and formed at the rear end of the inner cylinder are slidably fitted in guiding slots formed in a hollow tubular portion extending from a rear portion of the outer cylinder, and the male screw portions of the guiding projections are kept in threaded engagement with a female screw portion formed on an inner peripheral surface of the cylinder base portion. By virtue of the adoption of this mechanism, movement of the inner cylinder can be achieved accurately and precisely, thereby enabling various water discharging modes to be positively realized.

The various water spraying modes possible include a mode in which water is sprayed in the form of a fan-shaped spray, this mode never having been achieved in the prior art. This particular water spraying mode is achieved by the provision of a further embodiment of the present invention in which water is supplied through an auxiliary water spraying member defining a convex-lens shaped hole which opens into the porous plate.

DESCRIPTION OF THE PREFERRED EMBODIMENT

Figure 1:
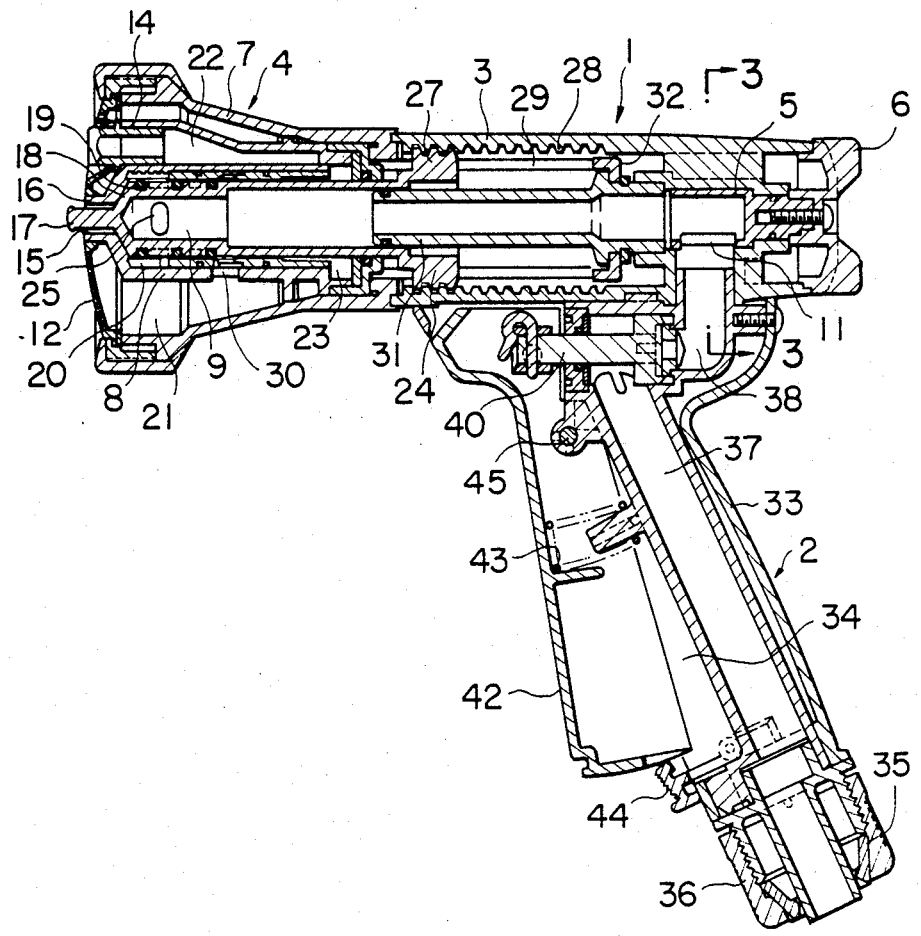
FIG. 1 is a sectional view of an embodiment of the water spraying nozzle of the present invention in a condition in which no water is being discharged and an inner cylinder of the water spraying nozzle is at its first position, taken along line 1—1 shown in FIG. 2.

In an embodiment of the water spraying nozzle of the present invention shown in the drawings, the water spraying nozzle generally comprises a water spraying portion 1 and a handle portion 2. The water spraying portion 1 has a cylindrical shape extending substantially horizontally. The handle portion 2 is continuously and obliquely provided at a rear downward portion of the water spraying portion 1. Thus, the overall configuration of the water spraying nozzle is pistol-shaped.

The water spraying portion 1 is provided with a cylinder base portion 3 connected to an upper portion of the handle portion 2, a water spraying head portion 4 mounted at the front end of the cylinder base portion 3, and a rotary valve 5 fitted within a rear end portion of the cylinder base portion 3 rotatably relative thereto. The rotary valve 5 is provided with a through-hole 11 capable of communicating with an opening at the upper end of a bent pipe 38 of the handle portion 2, described later. The communication of the through-hole 11 with the bent pipe 38 is established and blocked by the rotation of the rotary valve 5, the rotation of the rotary valve 5 being caused by operating a knob 6.

The water spraying head portion 4 has an outer cylinder 7 the rear end of which is slidably fitted on the cylinder base portion 3, an intermediate cylinder 8 located within the outer cylinder 7, an inner cylinder 9 disposed within the intermediate cylinder 8 movably in the horizontal direction, and a guide cylinder 10 fixed to the intermediate cylinder 8 in a gap between the cylinders 8 and 9 and disposed in sliding contact with the inner cylinder 9.

Figure 2:
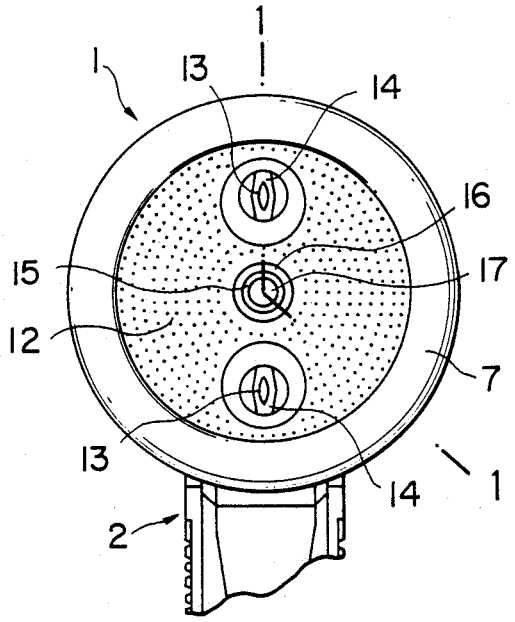
FIG. 2 is a front view of a water spraying head portion of the embodiment shown in FIG. 1.
Figure 3:
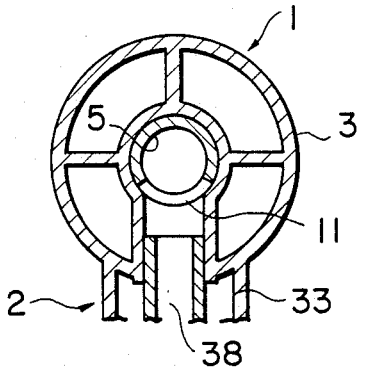
FIG. 3 is a sectional view taken along line 3—3 shown in FIG. 1.
Figure 11:
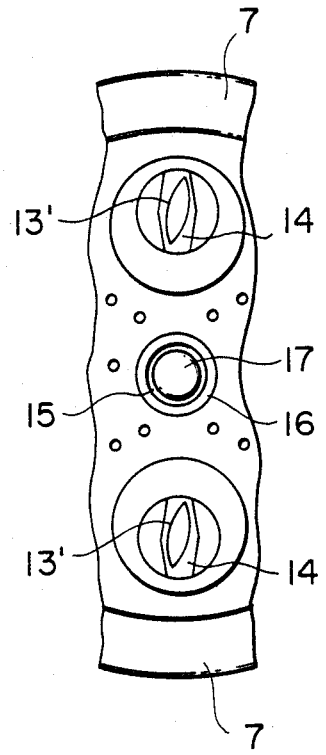
FIG. 11 is an enlarged front view of a part of another example of a water spraying head portion of the embodiment shown in FIG. 1, showing two convex-lens shaped holes arranged at the same angle in the same direction with respect to the diameter.

A porous plate 12, such as that shown in FIG. 2, is mounted on an opening at the front end of the outer cylinder 7. A central hole is formed in the center of the porous plate 12. Cylinder-shaped auxiliary water-spraying members 14, each having at its front end a hole 13 with a convex-lens shaped cross-section, are mounted on radially upper and lower portions of the porous plate 12. The holes 13 of the auxiliary water-spraying members 14 are aligned in the direction of the same diameter, as shown in FIG. 2. The auxiliary water-spraying members 14 may alternatively have, for instance, holes 13' inclined with respect to the diameter and arranged in parallel to each other, as shown in FIG. 11.

The intermediate cylinder 8 has at its front end a small-diameter portion 16 which is mounted to the central hole of the porous plate 12. The inner cylinder 9 has at its front end a bar portion 17 which is movable within an opening 15 defined by the small-diameter portion 16 of the intermediate cylinder 8, with a gap surrounding the bar portion 1.. A portion of the inner cylinder 9 which is at the base of the bar portion 17 has a peripheral wall forming a head provided conical valve portion 18. The valve portion 18 is capable of abutting on a valve seat 19 formed by an opposing peripheral wall of the intermediate cylinder 8.

The gap between the inner cylinder 9 and the intermediate cylinder 8 defines a first flow passage 20, and the gap between the intermediate cylinder 8 and the outer cylinder 7 defines a second flow passage 21. The second flow passage 21 includes a third flow passage 22 continuing with the holes 13 of the auxiliary water spraying members 14, and always communicating with a fourth flow passage 23 formed at a rear end portion of the intermediate cylinder 8.

A first through-hole 25 is formed at a front portion of the inner cylinder 9. When the inner cylinder 9 is at an advanced position thereof, the first flow passage 20 communicates with the inside of the inner cylinder 9 through the first-through hole 25, whereas when the inner cylinder 9 is at a retracted position thereof, the first through-hole 25 is closed by the guide cylinder 10. Annular seals 26 are mounted on peripheral wall portions at the front and the rear of the first through-hole 25. The rear end of the inner cylinder 9 is provided with guiding projections 24 at upper and lower portions thereof, as viewed in FIG. 1, which projections 24 each have a male screw portion 27 on its peripheral surface. The male screw portions 27 are in threaded engagement with a female screw portion 28 provided on a front half of the cylinder base portion 3, and the guiding projections 24 are slidably fitted in longitudinal guiding slots 29 formed in a tubular portion 32 extending horizontally from the rear end of the outer cylinder 7.

A second through-hole 30 is formed in the intermediate cylinder 8. When the inner cylinder 9 is at an advanced position thereof, the second through-hole 30 is closed by a cylinder wall of the inner cylinder 9, whereas when it is at a retracted position thereof, the second through-hole 30 communicates with the first through hole 25 through a third through-hole 46 formed in the guide cylinder 10.

Provided within the cylinder base portion 3 is a first water conduit 31 the rear end of which opposes the front end of the rotary valve 5 and a front part of which is slidably fitted within the inner cylinder 9 in a watertight manner.

The handle portion 2 includes a hollow tubular fixed portion 33. An opening 34 is formed on one side of the fixed portion 33 (i.e., on the left side, as viewed in FIG. 1). The fixed portion 33 has a hose connecting portion 35 formed at a lower tubular portion thereof. A cap nut 36 is threaded on the connecting portion 35 so that, when the cap nut 36 is operated, a hose, not shown, can be engaged with or disengaged from the connecting portion 35.

Provided within the fixed portion 33 is a second water conduit 37 the lower end of which communicates with the hose connecting portion 35. The bent pipe 38, which upwardly opens at an opening defined by an upper portion of the fixed portion 33, is provided above the second water conduit 37. A horizontal valve seat 39 is formed at a portion of the bent pipe 38. An opening-closing valve 40 is provided above the second water conduit 37 in opposition to the valve seat 39 and in such a manner as to be horizontally movable.

Figure 4:
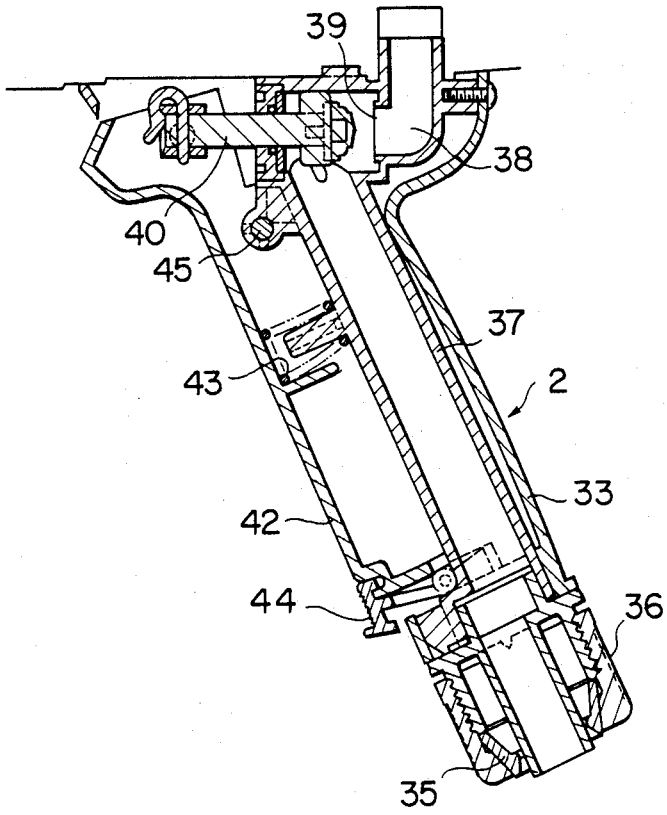
FIG. 4 is a sectional view of a handle portion of the embodiment shown in FIG. 1 in a condition in which water is being discharged.

The handle portion 2 also includes an opening-closing portion 42 rotatably supported via a shaft 45 by an upper portion of the second water conduit 37. A spring 43 is interposed between the opening-closing portion 42 and the second water conduit 37, and always urges the opening-closing portion 42 toward an open position of the opening-closing portion 42, as shown in FIG. 1. The opening-closing valve 40 has its base supported by an upper portion of the opening-closing portion 42. The opening-closing portion 42 has a lower portion engageable with a stopper 44 consisting of a spring member, so that the opening-closing member 42 can be stopped at a closed position thereof, as shown in FIG. 4.

(Operation)

The water spraying nozzle having the above-described construction operates in the following manner. FIG. 1 shows a condition in which no water is being discharged. While the water spraying nozzle is in this condition, a water supply hose, not shown, is connected with the hose connecting portion 35 by operating the cap nut 36.

In this condition, the opening-closing portion 42 is kept at its open position by the force of the spring 43, and the opening-closing valve 40, the base of which is supported by an upper portion of the opening-closing portion 42, is abutted on the valve seat 39 to maintain the second water conduit 37 closed and, hence, to prohibit the supply of water to the water spraying portion 1.

When water is to be sprayed, the handle portion 2 is manually held, with the opening-closing portion 42 being gripped by the fingers, whereby the opening-closing portion 42 is rotated about the shaft 45 against the force of the spring 43 to its closed position at which the stopper 44 engages with the associated lower portion of the opening-closing portion 42 to hold the opening-closing portion 42 at its closed position. By the rotation of the opening-closing portion 42, the opening-closing valve 40 is separated from the valve seat 39, thereby opening the second water conduit 37. At this time, if the through-hole 11 of the rotary valve 5 is set through the operation of the knob 6 at a position thereof at which it communicates with the opening at the upper end of the bent pipe 38, as shown in FIG. 1, water which has reached the interior of the second water conduit 37 is allowed to flow into the inner cylinder 9 through the first water conduit 31.

At this time, if the inner cylinder 9 is at a maximum advanced position (a first position) thereof, as shown in FIG. 1, the valve portion 18 at a front portion of the inner cylinder 9 abuts on the valve seat 19 of the intermediate cylinder 8, thereby forming a seal. In this case, therefore, water which has reached the interior of the inner cylinder 9 is prohibited from being discharged to the outside of the water spraying nozzle.

Figure 5:
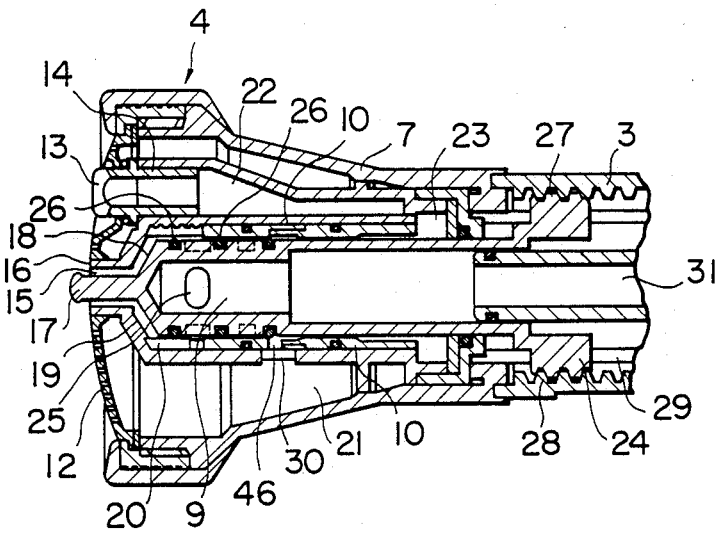
FIG. 5 is a sectional view of the water spraying head portion of the embodiment shown in FIG. 1 in a condition in which the inner cylinder is at its second position and water is being discharged in the form of mist.

Subsequently, when the outer cylinder 7 is held and rotated relative to the cylinder base portion 3, because the screw portions 27 and 28 are threaded engagement with each other and because the guiding projections 24, which are provided with the male screw portions 27, are slidably fitted in the guiding slots 29, the inner cylinder 9 is retracted to a second position thereof, as shown in FIG. 5. Consequently, the valve portion 18 is separated from the valve seat 19, thereby establishing communication between the opening 15 of the intermediate cylinder 8 and the first flow passage 20, the latter simultaneously communicating with the first through-hole 25 over substantially the entire area of the first through-hole 25. In this condition, water, the flow of which is unweakened, is discharged from the opening 15 in the form of mist.

Figure 6:
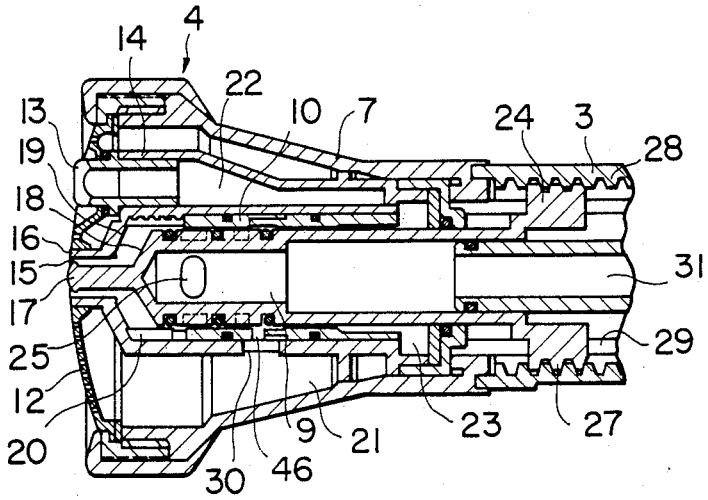
FIG. 6 is a sectional view of the water spraying head portion of the embodiment shown in FIG. 1 in a condition in which the inner cylinder is at its third position and water is being discharged in the form of a linear flow.

When the outer cylinder 7 is further rotated to retract the inner cylinder 9 to a third position thereof, as shown in FIG. 6, the first flow passage 20 communicates with a part of the first through-hole 25. Consequently, water, the flow of which is relatively weakened, is discharged from the opening 15 in the form of a linear flow.

Figure 7:
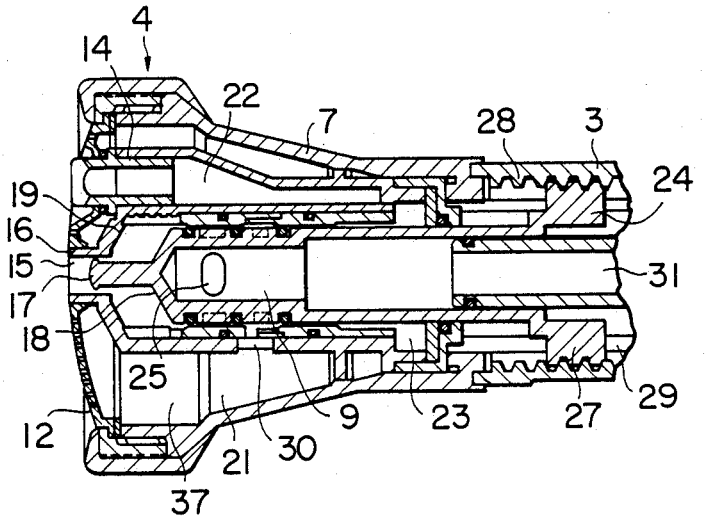
FIG. 7 is a sectional view of the water spraying head portion of the embodiment shown in FIG. 1 in a condition in which the inner cylinder is at its fourth position and the discharge of water is interrupted.

When the outer cylinder 7 is furthermore rotated to retract the inner cylinder 9 to a fourth position thereof, as shown in FIG. 7, the communication between the first flow passage 20 and the first through-hole 25 is completely blocked by the guide cylinder 10, thereby interrupting the discharge of water.

Figure 8:
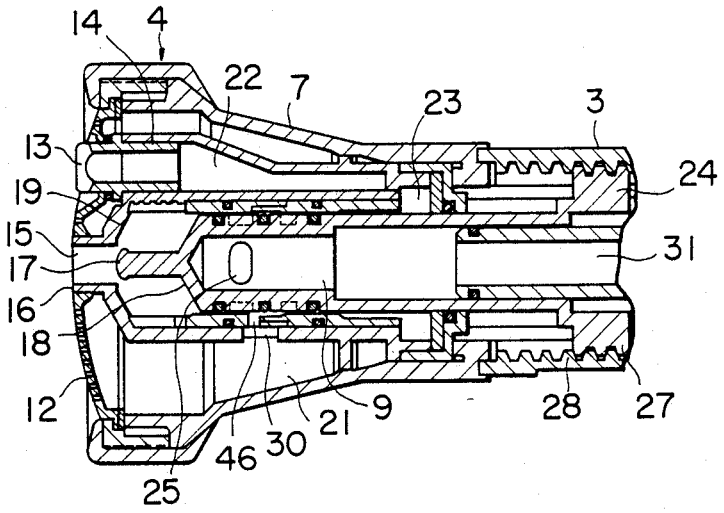
FIG. 8 is a sectional view of the water spraying head portion of the embodiment shown in FIG. 1 in a condition in which the inner cylinder is at its fifth position and water is being discharged in the form of a plurality of curved flows at a relatively low flow rate.

When the outer cylinder 7 is furthermore rotated to retract the inner cylinder 9 to a fifth position, as shown in FIG. 8, although the communication between the first flow passage 20 and the first through-hole 25 remains blocked, a part of the first through-hole 25 communicates with the third through-hole 46 of the guide cylinder 10 which third through-hole 46 communicates with the second through-hole 30 of the inter mediate cylinder 8 which in turn communicates with the second flow passage 21. Thus, in this condition, a part of the first through-hole 25 communicates with the second flow passage 21 through the third and second through-holes 46 and 30. Consequently, water is discharged through small holes of the porous plate 12 at a relatively low flow rate in the form of flows resembling those from a sprinkling can.

Figure 9:
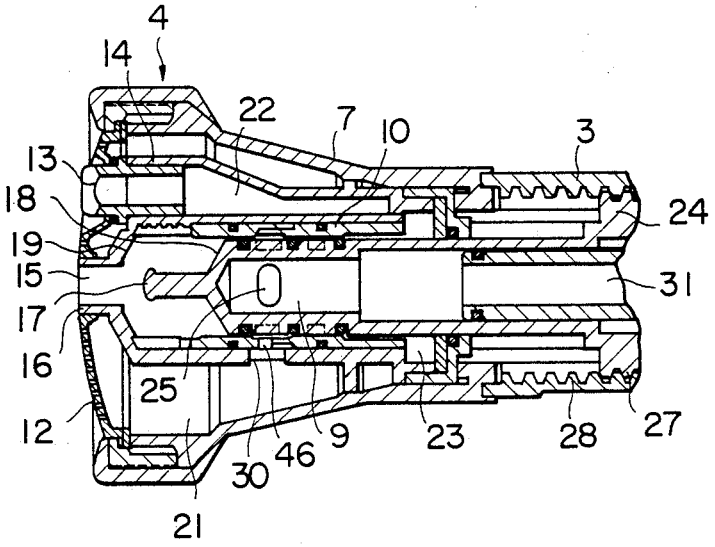
FIG. 9 is a sectional view of the water spraying head portion of the embodiment shown in FIG. 1 in a condition in which the inner cylinder is at its sixth position and water is being discharged in the form of a plurality of straight flows at an increased flow rate.

When the outer cylinder 7 is furthermore rotated to retract the inner cylinder 9 to a sixth position thereof, as shown in FIG. 9, substantially the entire area of the first through-hole 25 communicates with the third-through hole 46 and therethrough with the second through-hole 30 and the second flow passage 21. Consequently, water is discharged through the small holes of the porous plate 12 at an increased flow rate in the form of a shower.

Figure 10:
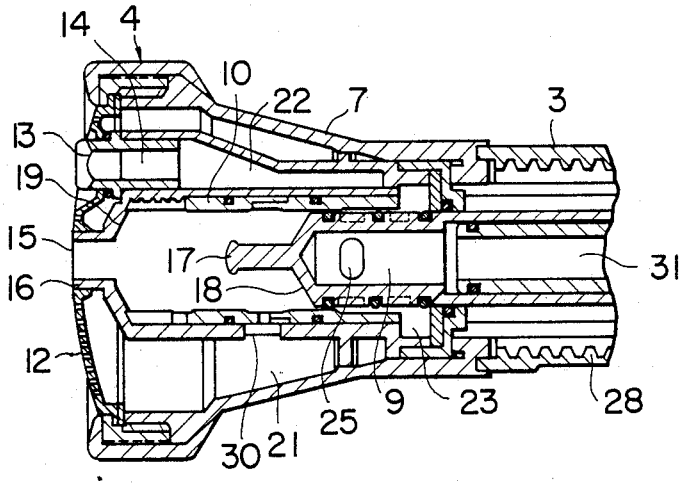
FIG. 10 is a sectional view of the water spraying head portion of the embodiment shown in FIG. 1 in a condition in which the inner cylinder is at its seventh position and water is being discharged in the form of fan-shaped flows.

When the outer cylinder 7 is furthermore rotated to retract the inner cylinder 9 to a seventh position thereof, as shown in FIG. 10, although the communication between the first through-hole 25 and the second through hole 30 is blocked by the guide cylinder 10, the first through-hole 25 communicates with the fourth flow passage 23. Consequently, water which has reached the fourth flow passage 23 flows through the third flow passage 22 into the auxiliary water spraying members 14. The water is then discharged from the convex-lens shaped holes 13 in the form of fan-shaped flows. At this time, if the holes 13 are positioned on the same diameter, as shown in FIG. 2, upper and lower fan-shaped flows of the water have their adjacent portions overlapped. On the other hand, if these holes 13 are inclined with respect to the diameter and are parallel to each other, flows of the water do not overlap with each other, enabling the water to be discharged forming smooth flows.

The above description has been given assuming that, when it is required to terminate the discharge of water, the opening-closing portion 42 and the inner cylinder 9 are respectively brought into the closed position, and the first position, shown in FIG. 1. However, termination may be achieved by rotating the knob 6 in such a manner that the rotary valve 5 is brought to a position thereof at which the through-hole 11 does not communicate with the opening of the bent pipe 38.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A water spraying nozzle comprising: a horizontal water spraying portion; and a handle portion provided on a rear downward portion of said water spraying portion and inclined obliquely rearward, said water spraying portion having at its front portion a water spraying head portion and at its rear portion a cylinder base portion connected to said water spraying head portion, said water spraying head portion including an outer cylinder rotatably connected at its rear end to said cylinder base portion, an intermediate cylinder disposed within said outer cylinder, and an inner cylinder disposed within said intermediate cylinder means causing said inner cylinder to be longitudinally slidable in response to the rotation of said outer cylinder, said outer cylinder defining at its front end an opening on which is mounted a porous plate, said inner cylinder having at a front portion thereof a valve portion for opening and closing a water spraying opening provided in said intermediate cylinder and also a first through-hole communicating the inside and the outside of said inner cylinder, a rear portion of said inner cylinder being connected to a first water conduit, said first through-hole cooperating with means allowing the inside of said inner cylinder to communicate with said water spraying opening in the first half of the retraction of said inner cylinder in response to the rotation of said outer cylinder and with said porous plate in the latter half of said retraction, said handle portion having a fixed portion fixed at its upper end to said water spraying portion and an opening-closing portion mounted to said fixed portion by means such as to be able to open and close relative thereto, a second water conduit capable of communicating with said first water conduit being disposed within said fixed portion, said second water conduit being opened or closed by a valve member provided in said opening-closing portion.

2. The water spraying nozzle as set forth in claim 1, further comprising a rotary valve member provided within said cylinder base portion and at the junction of said first and second water conduits to establish or block the communication between said first and second water conduits.

3. The water spraying nozzle as set forth in claim 1, wherein: said outer cylinder is provided with a hollow tubular portion extending rearward within said cylinder base portion, guiding slots being formed in said tubular portion in the longitudinal direction; and said inner cylinder has at its rear end guiding projections each having a male screw portion formed on its peripheral surface, said guiding projections being slidably fitted in said slots, with said male screw portions being in threaded engagement with a female screw portion formed on an inner peripheral surface of said cylinder base portion.

4. The water spraying nozzle as set forth in claim 1, wherein an auxiliary water spraying member having a convex-lens shaped hole formed therein is mounted on said porous plate, said auxiliary water spraying member communicating with a third flow passage capable of communicating with said first through-hole when the inner cylinder has moved to its rearmost position.

* * * * *